United States Patent [19]

Lawlor

[11] Patent Number: 4,494,321

[45] Date of Patent: Jan. 22, 1985

[54] SHOCK RESISTANT SHOE SOLE

[76] Inventor: Kevin Lawlor, 2 A Oakland St., Brighton, Mass. 02135

[21] Appl. No.: 441,417

[22] Filed: Nov. 15, 1982

[51] Int. Cl.[3] ..... A43B 13/20; A43B 13/12

[52] U.S. Cl. ..... 36/28; 36/25 R; 36/59 C; 36/29; D2/320

[58] Field of Search ..... 36/28, 32 R, 30 R, 102, 36/59 C, 129, 29, 25 R, 114, 7.8; D2/320

[56] References Cited

U.S. PATENT DOCUMENTS

| | | | |
|---|---|---|---|
| 1,352,731 | 9/1920 | Egerton | 36/30 R |
| 2,090,881 | 8/1937 | Wilson | 36/29 |
| 2,424,463 | 7/1947 | Hogg | 36/59 C |
| 2,950,118 | 8/1960 | Sharpe | 36/28 |
| 3,918,181 | 11/1975 | Inohara | 36/129 |
| 4,130,947 | 12/1978 | Denu | 36/32 R |
| 4,151,661 | 5/1979 | Namba et al. | 36/30 R |
| 4,271,606 | 6/1981 | Rudy | 36/32 R |
| 4,358,902 | 11/1982 | Cole et al. | 36/29 |

FOREIGN PATENT DOCUMENTS

| | | | |
|---|---|---|---|
| 341490 | 8/1904 | France | 36/29 |

*Primary Examiner*—Werner H. Schroeder
*Assistant Examiner*—Steven N. Meyers
*Attorney, Agent, or Firm*—Jerry Cohen; M. Lawrence Oliverio; William E. Noonan

[57] ABSTRACT

A shock absorbent shoe sole (10) including an upper sole (14) and a bottom sole (12) attached to the bottom of the upper sole, the bottom sole including one or more inverted cups (22, and 24) disposed therein; each cup is located directly beneath and pointed convexly toward a natural contact point (60, 62, 64) of the human foot (54) for absorbing and dispersing shock generated at the natural contact point during a foot step.

12 Claims, 6 Drawing Figures

SHOCK RESISTANT SHOE SOLE

BACKGROUND OF THE INVENTION

This invention relates to an improved shock resistant shoe sole which is particularly appropriate for use in running shoes, sneakers and other athletic footwear.

During intense athletic activities such as those which involve sprinting, jogging and other forms of running tremendous impact forces are experienced by the foot as it bears the entire burden of the athlete's weight each time it encounters the ground. In the sport of long distance running, in particular, such impact shock upon the foot may over a prolonged period, repeated a number of times, such stress due to a significant number of injuries to the bones, muscles, joints, ligaments and tendons of the foot and leg have become associated with athletic activity. Recently, because of increased interest in physical fitness, and running in particular, the problem of foot and leg injuries has become acute and widespread. Remedies have focused upon more effective warm-up (e.g. calisthenics) techniques and improved equipment (e.g. running and other athletic shoe) design. Stress injuries to feet and legs persist, however.

The midsole presently employed by the typical athletic shoe does not exhibit both optimal shock resistance and stability control. As the midsole is made of a softer material, (e.g. foam), its shock absorbent qualities are enhanced but stability and control are lost. This occurs because a certain proportion of the impact shock is transmitted up the bone structure to the ankle, causing it to wobble. Harder materials, (e.g. rubber), are more stable (less shock transmitted to the ankle), but result in more of the impact shock being absorbed directly by the foot.

SUMMARY OF THE INVENTION

It is, therefore, an object of this invention to provide an improved shock resistant shoe sole which reduces the impact shock experienced by the foot when engaging the ground and thereby reduces foot injuries which may occur during running and other physical activities.

It is a further object of this invention to provide a shock resistant shoe sole which enhances both impact shock absorbtion and stability control during foot to ground impact.

It is a further object of this invention to provide a shock resistant shoe sole which may be effectively employed by sneakers, running shoes, and other athletic footwear.

This invention results from a realization that during a walking or running footstep the foot makes impact with the ground at a number of natural contact points. Typically, three such points are exhibited:

The calcaneum or heel bone and the first and fifth matatarsels. An effective manner of absorbing impact shock experienced during running or walking should involve dispersing and mollifying the shock of each of these contact points in an optimal manner. This invention also recognizes that an effective means of shock absorption and dispersion is exhibited by arch or cup-like structures where impact shock at the apec thereof is transmitted down the sides of the structure for dispersal therefrom.

Therefore, this invention features a shock absorbent shoe sole which includes an upper sole. A bottom sole is attached to the bottom of the upper sole and includes one or more inverted cups disposed therein. Each cup is located directly beneath and pointed convexly toward a natural contact point of the human foot for absorbing and dispersing shock generated at the natural contact point during a footstep.

In a preferred embodiment, the uppersole may include a relatively soft material such as foam for absorbing impact shock and a relatively hard material such as rubber for absorbing and transmitting such shock. The bottom sole may include one or more relatively thick portions, each having an inverted cup disposed therein, and each uppersole may include one or more openings therethrough. Each such opening accommodates one thick portion so that the thick portion is substantially flush with the top of the upper sole. Alternatively, the upper sole may be provided with recesses for accomodating the thick portions such that a relatively thin portion of a midsole is interposed between each thick portion of bottom sole and a natural contact point. Reducing the thickness of a midsole, where typically softer foam is employed, in the above manner provides for a more solid sole, less ankle wobble and enhanced stability.

Each cup may be elliptical in horizontal cross sectional shape and may be disposed in the bottom surface of the bottom sole. Alternatively, each cup may include a cup shaped cavity located between the top and bottom surfaces of the bottom sole. Typically, three inverted cups are provided. One is located directly beneath the heel bone and two are located directly beneath associated (e.g. first and fifth) metatarsels of the foot.

An inner sole may be attached to the top of the upper sole such that the latter effectively acts as a midsole. The upper sole may include a wedge portion for locating beneath the arch of the foot.

The cups of this invention act to cushion the natural contact points (e.g. bones) of the foot with a cavity of air in order to dampen the impact shock experienced by these points during running etc. Shock absorbency is assisted by the reverberation characteristics exhibited by the cups and by the arch-like shock dispersal performed thereby. Dispersed shock may be transmitted to the foam midsole for absorption thereby. Because of such improved shock absorbent features, the foam of this invention may be made denser to enhance shoe sole stability.

Other objects, features and advantages of the invention will be apparent from the following detailed description of preferred embodiments with reference therein to the accompanying drawing in which:

DETAILED DESCRIPTION OF PREFERRED EMBODIMENTS

Figure 1:
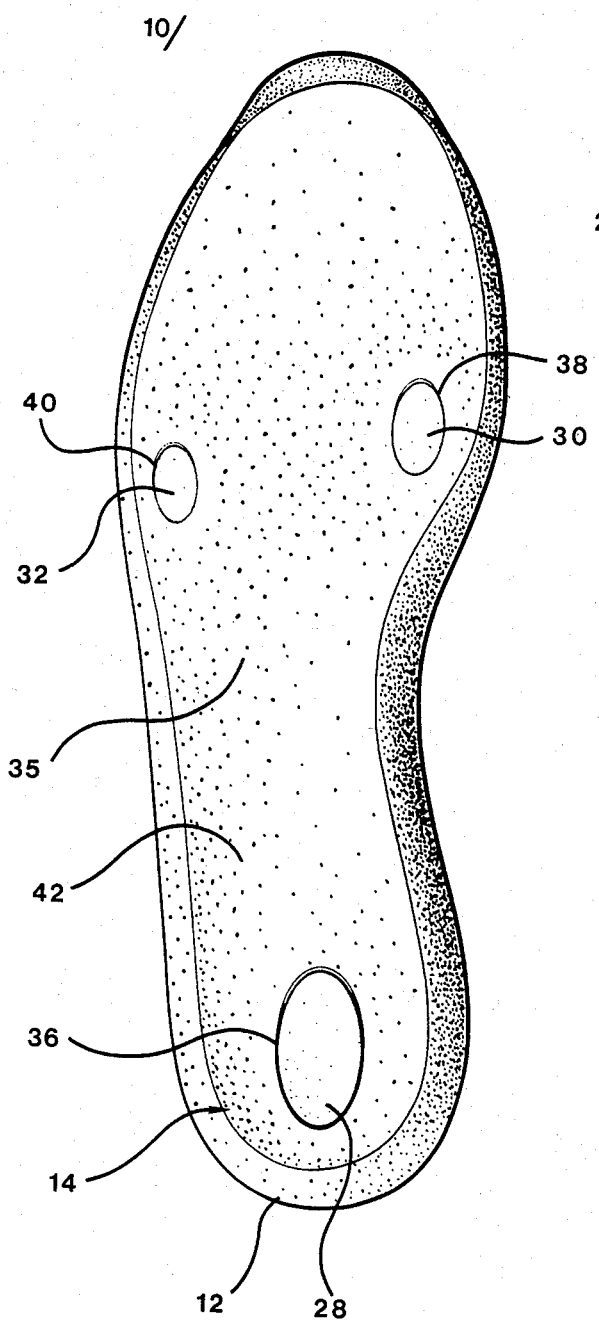
FIG. 1 is a top plan view of the shock resistant shoe sole of this invention.
Figure 2:
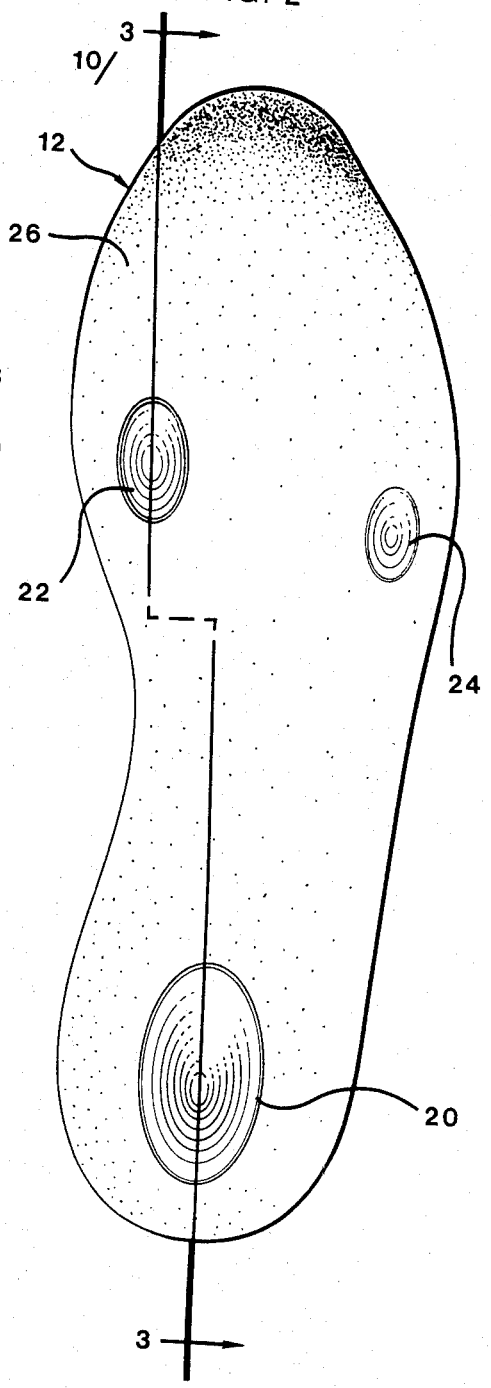
FIG. 2 is a bottom plan view of the shoe sole of FIG. 1.
Figure 3:
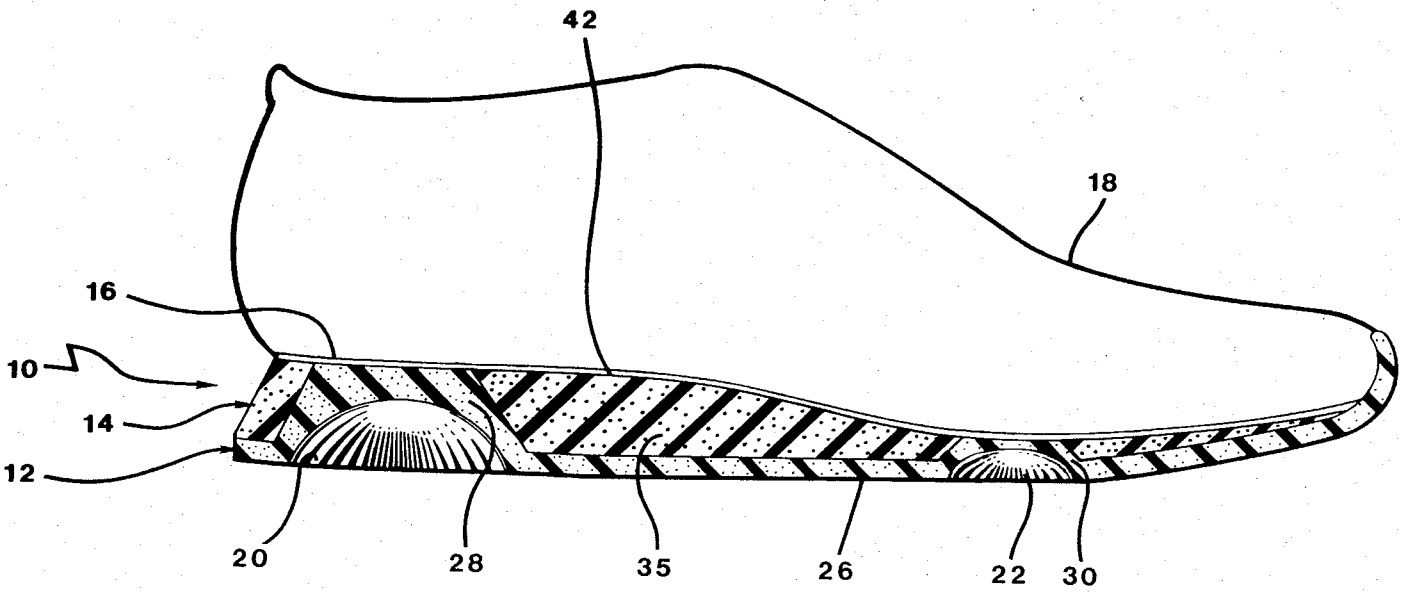
FIG. 3 is a cross sectional view taken along line 3–3 of FIG. 2.

There is shown in FIGS. 1–3 an improved shock resistant shoe sole 10 according to this invention. A left sole is illustrated but it should be understood that identical structure and function is exhibited by a right shoe sole made according to this invention. A rubber bottom sole 12 is attached to the bottom of a dense foam upper midsole 14 by glue, epoxy or other conventional means of the shoemaking art. An inner sole 16 may be similarly attached to the top of midsole 14. As illustrated most clearly in FIG. 3, an upper shoe portion 18 is attached to shoe sole 10 by conventional means.

Bottom sole 12 includes three (3) inverted cup shaped cavities 20, 22, 24 disposed in the bottom surface 26 thereof. Alternatively, the cups may be located between a flat bottom surface 26 and midsole 14 form, in effect, a cup shaped bubble in bottom sole 12. As shown most clearly in FIG. 3 the cups are directed convexly upward and concavely toward the ground. Rearward cup 20 is disposed in a thick portion 28 of sole 12 and forward cups 22 and 24 are disposed in thick portions 30 and 32. Note in FIG. 3 that forward cup 24 and the thick portion accomodating cup 24 are obscured. As illustrated best in FIG. 2, each cup has an elliptical cross sectional shape.

Figure 4:
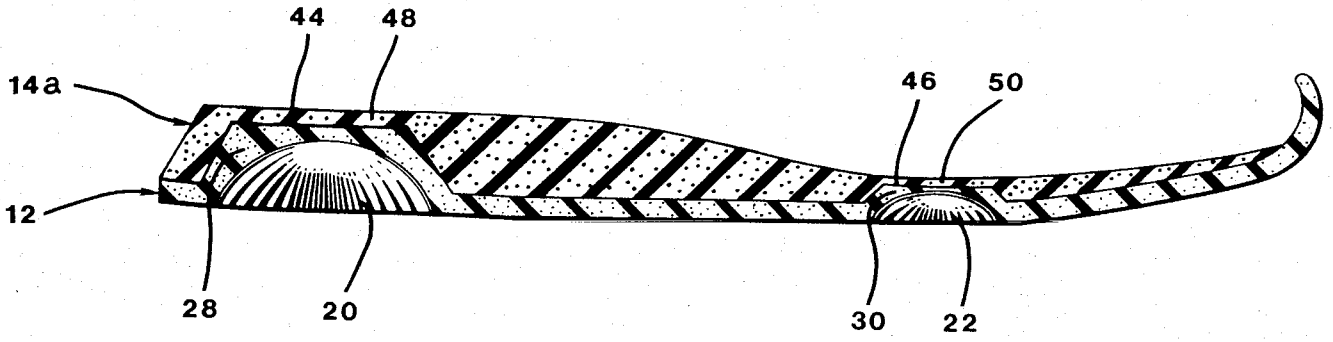
FIG. 4 is a cross sectional view of an alternative shoe sole according to this invention.

Midsole 14, FIGS. 1 and 3, includes a wedge portion 35 and has elliptical openings 36, 38, and 40 disposed therethrough. Rearward opening 36 accomodates thick portion 28 of bottom sole 12 and foward openings 38, 40 accomodate thick portions 30 and 30 respectively of bottom sole 12. In this manner, the top surfaces of thick portions 30, 32, and 36 are flush with the top surface 42 of midsole 14, (e.g. the thick portions directly encounter inner sole 16. Alternatively, as shown in FIG. 4, midsole **14*a* may include recesses, such as 44, and 46 which do not extend completely through the midsole, for accomodating thick portions 28 and 30. Note that the remaining forward thick portion and accomodating recess are obscured. In the embodiment of FIG. 4 a relatively thin section 48, 50 of midsole 14** is thus superposed above each thick portion and the cup disposed therein.

Bottom surface 26 (FIGS. 1–3) of bottom sole 12 is shown as primarily flat. Alternatively, however, ribs or other patterns for enhancing gripping contact between the shoe and the ground may be provided on surface 26.

Figure 5:
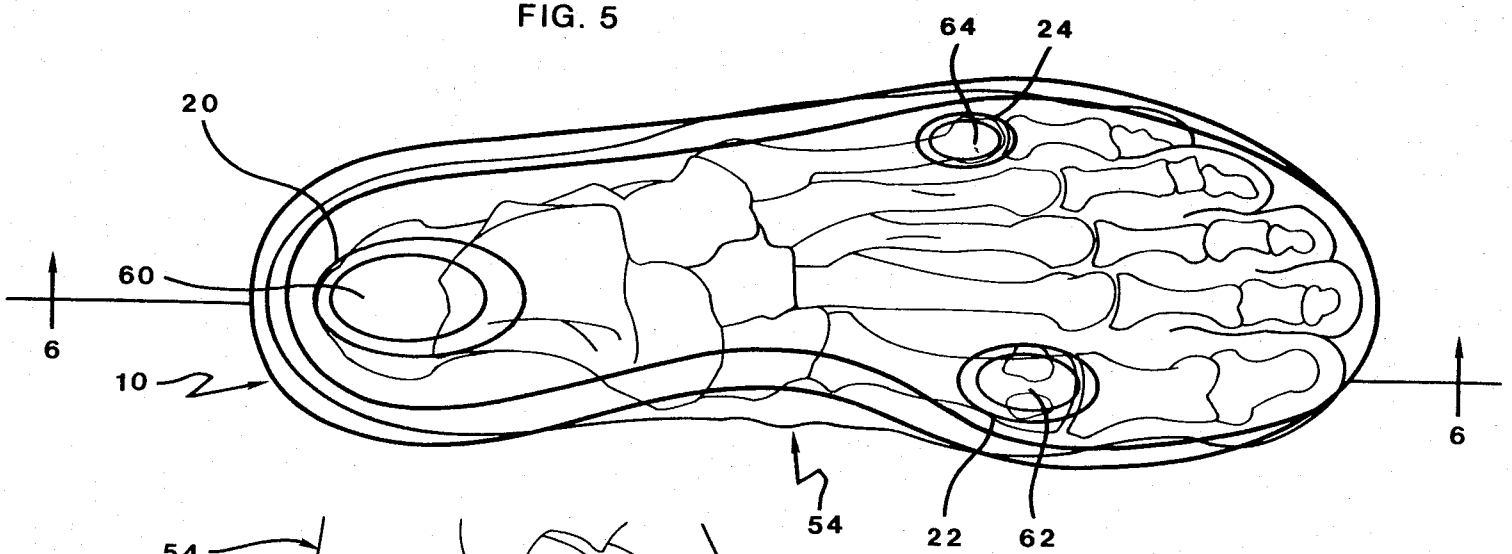
FIG. 5 is a top view showing the shoe sole of FIG. 1 and the bones of a human foot thereabove.
Figure 6:
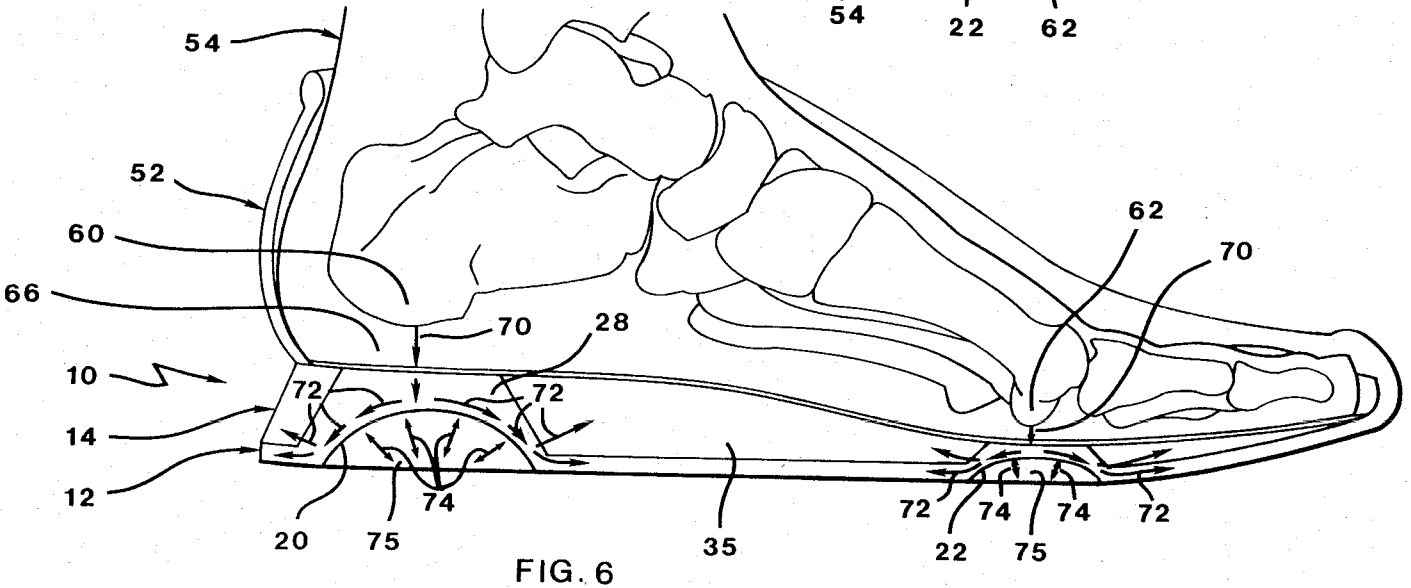
FIG. 6 is a side cross sectional view taken along lines 6—6 of FIG. 5.

In FIGS. 5 and 6, shoe sole 10 is illustrated as part of an athletic shoe 52 which is being worn by a left foot 54. The skeletal structure of foot 54 is shown in order to illustrate the manner in which the sole of this invention acts to provide shock resistant and stable running characteristics, thereby reducing foot injuries. Similar principles apply to a right shoesole made according to this invention and worn on the right foot.

The human foot typically includes three (3) natural contact points. These include the calcaneum or heel bone. 60 and the first and fifth metatarsels 62 and 64. During a footstep or a runner's stride, first the heel bone 60 and then the metatarsels 62 and 64 will encounter (e.g. make natural contact with) the ground (through, of course, the sole 10, a sock (if worn) and skin, and tissue 66). These natural contact points 60, 62, and 64 bear the impact shock of each step taken. As the running activity becomes more strenuous or prolonged, such impact shock is amplified.

According to the dictates of this invention, each of the cups 20, 22, and 24 is located directly beneath and pointed convexly toward one of the natural contact points 60, 62, and 64; rearward cup 20 is beneath heel bone 60; cup 22 is beneath first metatarsal 62; and cup 24 is beneath fifth metatarsal 64. The elliptical shape of each cup is contoured to wedge portion 35 of midsole 14 which is located beneath the arch of foot 54 to substantially match the natural contact point thereabove.

As shown in FIG. 6, during a footstep heel bone 60 is first driven downwardly in the direction of arrow 70. The impact shock on the bone 60 is transmitted through rearward thick portion 28 and therein is directed (as shown by arrows 72) down the sides of cup 20. This force is then dispersed into the hard rubber bottom sole 12 and info the relatively softer foam of midsole 14 such that the impact shock encounters cup 20 (as indicated by doubleheaded arrows 74) the inside wall of the cup reverberates in order to enhance the shockabsorbency of the rubber bottom sole 12. Heel bone is effectively cushioned by the air 75 in cup 20.

Similar shock resistance is provided by the forward cups 22, 24. As shown in FIG. 6, as first metatarsel 62 is driven downwardly in the direction of arrow 70 to make natural contact, the impact shock generated thereby is transmitted through thick portion 32 and is dispersed outwardly, arrows 72 by cup 22 through rubber bottom sole 12 and foam midsole 14. Reverberation, arrows 74, also enhances shock absorbency.

Therefore, due to shock dispersion along the cups and reverberation thereof, the cups 20, 22, and 24 greatly improve the shock absorbent characteristics of the rubber bottom sole 12. Shock resistance is enhanced for beyond the limited shock absorbing exhibited by solid rubber soles lacking such cups. Accordingly, the foam normally required to provide shock absorbency may be eliminated entirely from between the natural contact points and the hard rubber bottom sole 12. Alternatively, as shown in FIG. 4 such foam interposition may be drastically reduced in thickness. In either event, reducing the thickness of the foam midsole directly below the natural contact points contributes greatly to enhanced stability: Because the impact is spread out by the cups, it is prevented from reacting back up the foot to cause wobbling of the ankle. The shock absorbing cups also permit denser, and thus more stable foam to be used throughout the midsole. Therefore, this invention provides a sole having the stability of a denser, harder material while exhibiting exceptional shock resistant characteristics, normally present only in softer foams, through employment of the shock absorbing cups 20, 22, and 24. Stress upon and resultant injuries to the foot are thus reduced.

It is evident that those skilled in the art, once given the benefit of the foregoing disclosure, may now make numerous other uses and modifications of, and departures from, the specific embodiments described herein without departing from the inventive concepts. Consequently, the invention is to be construed as embracing each and every novel feature and novel combination of features present in, or possessed by, the apparatus and techniques herein disclosed and limited solely by the spirit and scope of the appended claims.

What is claimed is:

1. A shock absorbent shoe sole comprising:

(a) an upper sole having a thickness; and (b) a bottom sole attached to the bottom of said upper sole and including one or more inverted cups dispersed therein, each cup being located directly beneath and pointed convexly toward a natural contact of the human foot for absorbing and dispersing shock generated at said natural contact point during a foot step, each of said cups including a cup shaped cavity penetrating the thickness of the upper sole to such a degree that the upper sole plays essentially no part in absorbing shock at the natural contact point during a footstep.

2. Shoe sole in accordance with claim 1, wherein said upper sole includes a relatively soft material for absorbing shock during a footstep and said bottom sole includes a relatively hard material for absorbing and transmitting such shock.

3. Shoe sole in accordance with claim 1, wherein said upper sole includes foam.

4. Shoe sole in accordance with claim 1, wherein said bottom sole includes rubber.

5. Shoe sole in accordance with claim 1, wherein each said cup is disposed in the bottom surface of said bottom sole.

6. Shoe sole in accordance with claim 1, further including an inner sole attached to the top of said upper sole.

7. Shoe sole in accordance with claim 1, wherein said upper sole includes a wedge portion located beneath the arch of the foot.

8. Shoe sole in accordance with claim 1, wherein said bottom sole includes three (3) inverted cups, one located directly beneath the heel bone and two located directly beneath associated metatarsels of the foot.

9. Shoe sole in accordance with claim 1, wherein each said cup includes an elliptical horizontally cross sectional shape.

10. a shock absorbent shoe sole comprising:

(a) an upper sole; and (b) a bottom sole attached to the bottom of said upper sole and including one or more inverted cups dispersed therein, each cup being located directly beneath and pointed convexly toward a natural contact of the human foot for absorbing and dispersing shock generated at said natural contact point during a foot step, said bottom sole including one or more relatively thick portions, each having an inverted cup dispersed therein and said upper sole including one or more recesses therein, each said recess accomodating one said thick portion of said bottom sole such that a relatively thin portion of said upper sole is interposed between each said inverted cup and a natural contact point of the foot.

11. A shock absorbent shoe sole comprising:

(a) an upper sole; and (b) a bottom sole attached to the bottom of said upper sole and including one or more inverted cups dispersed therein, each cup being located directly beneath and pointed convexly toward a natural contact of the human foot for absorbing and dispersing shock generated at said natural contact point during a foot step, said bottom sole including one or more relatively thick portions, each having an inverted cup dispersed therein, and said upper sole including one or more openings therethrough, each said opening accomodating one said thick portion of said bottom sole such that said thick portion of said bottom sole such that said thick portion is substantially flush with the top surface of said upper sole.

12. Shoe sole in accordance with claim 10 wherein each cup includes a cup shaped cavity interspersed between the top and bottom surfaces of said bottom sole.

* * * * *